US005873348A

United States Patent [19]

Fuchs et al.

[11] Patent Number: 5,873,348

[45] Date of Patent: Feb. 23, 1999

[54] FUEL RECIRCULATION AND WARMING SYSTEM AND METHOD

[75] Inventors: Daniel G. Fuchs, Tualatin; Matthew G. Markstaller, West Linn, both of Oreg.

[73] Assignee: Freightliner Corporation, Portland, Oreg.

[21] Appl. No.: 726,954

[22] Filed: Oct. 7, 1996

[51] Int. Cl.[6] ..... F02M 37/20

[52] U.S. Cl. ..... 123/514; 123/552

[58] Field of Search ..... 123/514, 557, 123/549, 545, 546, 547, 552

[56] References Cited

U.S. PATENT DOCUMENTS

| | | | |
|---|---|---|---|
| 2,412,019 | 12/1946 | Walker . | |
| 4,279,232 | 7/1981 | Schuster et al. . | |
| 4,340,023 | 7/1982 | Creager . | |
| 4,452,213 | 6/1984 | Duprez . | |
| 4,502,450 | 3/1985 | Duprez | 123/514 |
| 4,850,327 | 7/1989 | Fayard . | |
| 4,989,572 | 2/1991 | Giacomazzi et al. . | |
| 5,085,198 | 2/1992 | Bartlett et al. | 123/514 |
| 5,197,443 | 3/1993 | Hodgkins . | |
| 5,197,445 | 3/1993 | Casari . | |
| 5,207,203 | 5/1993 | Wagner et al. | 123/514 |
| 5,398,659 | 3/1995 | Zimmerman et al. . | |
| 5,533,486 | 7/1996 | Qutub . | |

FOREIGN PATENT DOCUMENTS

| | | |
|---|---|---|
| 58-77158 (A) | 5/1983 | Japan . |

*Primary Examiner*—Marguerite McMahon

*Attorney, Agent, or Firm*—Klarquist Sparkman Campbell Leigh & Whinston, LLP

[57] ABSTRACT

A fuel system having a fuel tank for storing a supply of fuel for an internal combustion engine is provided with a fuel recirculation system. Fuel is supplied from the fuel tank to the engine through a supply line and excess fuel is returned from the engine to the tank through a return line. The fuel in the return line is typically warmed as it passes through or in proximity to the engine. A valve is positioned within the fuel tank to sense the temperature of the fuel supplied to the engine and, when the temperature is colder than desired, divert a portion of the warmed return fuel back to the supply line. The diverted fuel helps warm the fuel supplied to the engine and prevent waxing in the fuel system. When the fuel supplied to the engine is not colder than desired, the valve is closed and the warmed fuel is returned to the fuel tank.

16 Claims, 3 Drawing Sheets

FUEL RECIRCULATION AND WARMING SYSTEM AND METHOD

BACKGROUND OF THE INVENTION

1. Field of the Invention

The present invention relates to a system for recirculating and warming fuel and, more particularly, to a system for providing increased protection against the adverse effects of cold weather on fuel circulation systems, such as those used in connection with diesel engines.

2. Description of Related Art

Some fuels are adversely affected by extreme weather conditions. For example, diesel fuel may tend to thicken, or wax, at cold temperatures. In particular, paraffin wax and other materials may crystallize and precipitate from the fuel to form solids. These solids can build up and clog fuel lines, fuel filters and the like.

In many diesel engines, fuel is withdrawn from one or more fuel tanks and pumped through a supply line to the engine. The fuel needed for combustion is injected into the engine and the excess is returned through a return line to the fuel tank. Once the engine starts, the fuel is warmed as it passes through or in close proximity with the engine and the fuel in the return line is often at a higher temperature than the fuel in the supply line. As a result, waxing and the associated clogging and build-up problems are often more likely to occur in the supply line and other components which encounter the fuel as it is supplied from the tank than in components which encounter the fuel as it returns to the tank.

The return of warmed fuel to the fuel tank may, in some cases, help reduce problems associated with waxing. However, fuel tanks are typically relatively large in comparison to the amount of warmed return fuel. Thus, the warmed return fuel may have only a small or very slow effect on the temperature of the large volume of fuel within the tank. This is particularly true as many operators prefer to keep fuel tanks relatively full in cold conditions. Moreover, if the vehicle is driven in cold conditions, the cold air flowing around the fuel tanks and fuel lines tends to cool the fuel within, counteracting the warming effect of any warmed return fuel added to the tanks.

Some fuel supply systems attempt to alleviate the problems associated with waxing by circulating engine coolant, warmed by the engine, around fuel system components in an effort to warm them. Such systems, however, require a separate circuit to allow such circulation of the engine coolant. The provision of such a circuit increases the cost and complexity of both the fuel system and the engine cooling system.

Other fuel systems provide a thermostatic valve situated adjacent the engine which diverts a portion of the warmed return fuel back into a point in the supply line adjacent the engine. Thus, warmed fuel is returned immediately to the engine. Such system may help protect pumps, filters and injectors located between the valve and the engine. However, such systems make no provision for that portion of the supply line or other fuel system components located between the fuel tank and the valve. Should this portion of the supply line become clogged due to waxing, there is no way to replenish fuel as it is combusted and, after time, the system will exhaust the supply of recirculating warm fuel.

SUMMARY OF THE INVENTION

Accordingly, there is a need for a fuel system which improves upon the shortcomings of existing systems and addresses the problems of fuel waxing.

One objective of the present invention is to provide an improved fuel system for regulating the temperature of fuel supplied to an internal combustion engine.

It is another objective of the present invention to provide a fuel supply system that is reliable and uncomplicated.

In accordance with these and other objectives, a preferred embodiment of the present invention is incorporated into a fuel system having a fuel tank for storing a supply of fuel for an internal combustion engine. In a preferred fuel recirculation system, a supply line is provided for transporting fuel from the fuel tank to the engine and a return line is provided for transporting fuel from the engine to the fuel tank.

A valve is positioned within or near the fuel tank. The valve has a first conduit having an inlet in fluid communication with the fuel tank and an outlet coupled to the supply line. A second conduit in the valve has an inlet coupled to the return line and an outlet in fluid communication with the fuel tank. A third conduit joins the first conduit and the second conduit. The valve has a valve member which is movable between a first position in which fuel is allowed to flow from the second conduit, through the third conduit and into the first conduit and a second position in which fuel is not allowed to flow through the third conduit. A thermal actuator is positioned to sense the temperature of the fuel and move the valve member between the first position and the second position based on the sensed temperature.

In operation, fuel is withdrawn from the fuel within the tank and supplied to the inlet of the first conduit, through the first conduit and to the supply line where it is transported to the engine. Excess fuel that is not required for combustion passes through the return line to the inlet of the second conduit. Typically, the returned fuel has been warmed as it passes through or next to the engine and is warmer than the fuel in the tank or the supply line. When the thermal actuator senses that the fuel being provided to the engine is too cold, it positions the valve member in the first position. This allows a portion of the warmed return fuel to be diverted through the third conduit and into the first conduit where it mixes with the fuel withdrawn from the tank before being supplied to the engine. Because the valve is positioned within or adjacent the fuel tank, warmed fuel can be recirculated through all of the fuel system components external to the tank to help protect against waxing.

In one aspect of the invention, the thermal actuator senses the temperature of the fuel within the first conduit at a point after any diverted return fuel has been mixed with the fuel withdrawn from the fuel within the tank. In this way, the sensed temperature more accurately reflects the temperature of fuel being provided to the supply line.

Other objects and aspects of the invention will become apparent to those skilled in the art from the detailed description of the invention which is presented by way of example and not as a limitation of the present invention.

DESCRIPTION OF THE ILLUSTRATED EMBODIMENT

Figure 1:
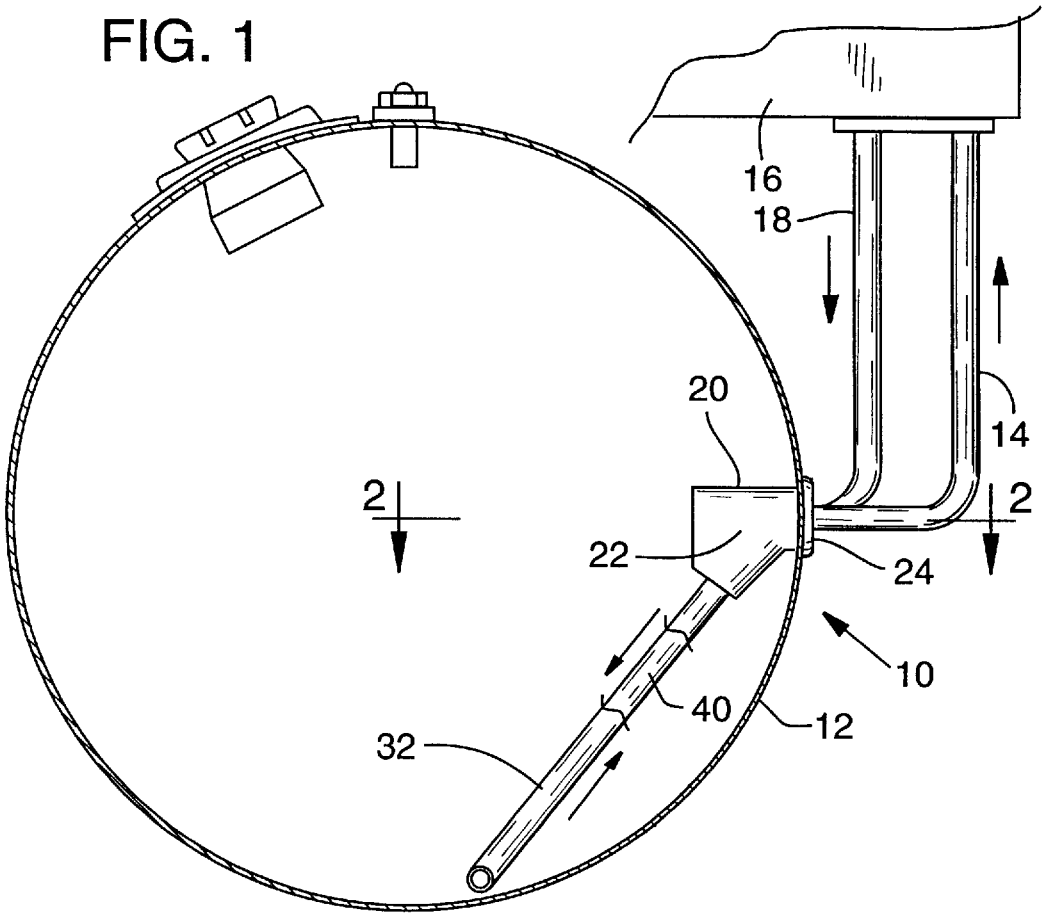
FIG. 1 illustrates a fuel recirculation system in accordance with a preferred embodiment of the present invention.

A fuel system in accordance with a preferred embodiment of the present invention is indicated in FIG. 1 as reference numeral 10. The illustrated fuel system 10 has a fuel tank 12 for containing a supply of fuel. A supply line 14 is provided to transport fuel from the fuel tank 12 to an engine 16. Excess fuel not used for combustion is returned to the fuel tank 12 through a return line 18. The return fuel is commonly warmed as it circulates next to or through the engine. A valve 20 is positioned within or adjacent the fuel tank. The valve 20 allows for a portion of the warmed fuel from the return line 18 to be diverted and mixed with the fuel entering the supply line 14. The warmed return fuel helps to warm the fuel entering the supply line 14 so as to reduce the adverse effects of waxing.

The valve 20 in the illustrated embodiment, seen best in FIGS. 2–6, has a valve body 22 which is positioned inside the fuel tank 12. The illustrated valve body 22 is provided with a flange 24 which abuts and engages an aperture formed in the fuel tank 12 to hold the valve body 22 in place within the fuel tank 12. The flange 24 may be fixed to the fuel tank by welding or by some other suitable manner.

A first conduit 26, having an inlet 28 and an outlet 30, is formed in the valve body 22. A supply tube 32 has one end connected to the inlet 28 and the other end located near the bottom of the fuel tank 12. The outlet 30 is coupled to the supply line 14. The valve body is also provided with a second conduit 34, also having an inlet 36 and an outlet 38. The inlet 36 is coupled to the return line 18 and the outlet 38 is coupled to a return tube 40 which extends to near the bottom of the fuel tank 12.

A third conduit 42 within the valve body 22 extends from the second conduit 34 to the first conduit 26. In the illustrated embodiment, a spool 44 with an annular groove 46 serves as a valve member. The spool 44 is movable between an open position, illustrated in FIG. 2, and a closed position illustrated in FIG. 3. In the open position, shown in FIG. 2, the annular groove 46 is positioned within the third conduit 42 to allow the flow of fuel around the spool 44. In the closed position, shown in FIG. 3, the annular groove 46 is not within the third conduit 42 so that the spool 44 blocks the flow of fuel through the third conduit 42.

A spring 48 is positioned to bias the spool 44 toward the open position. The biasing force of the spring 48 can be overcome by the operation of a thermal actuator 50 to move the spool 44 to the closed position. The thermal actuator 50 includes a sensor 52 and a plunger 54. The sensor 52 is positioned to sense the temperature of fuel being provided to the supply line. When the temperature is below a predetermined level, the plunger 54 is retracted and the spring biases the spool 44 into the open position. When the temperature is above a second predetermined level, the plunger is extended to move the spool into the closed position. This, and other suitable types of thermal actuators are well known to those in the art.

In the illustrated embodiment, a simple configuration is used to provide the desired structure. In particular, a bore 56 is formed through the valve body 22. The bore 56 is intersected by and forms a part of the first conduit 26 and the third conduit 42. One end of the bore 56 is blocked using a plug 58 which can be press fit or threaded into the bore 56. Alternatively, the bore need not extend completely through the valve body and no plug is needed. The thermal actuator 50 is positioned in the bore 56 with the end of the plunger 54 engaging the plug 58 and the sensor 52 adjacent the intersection of the first conduit 26 and the bore 56. The spool 44 is positioned within the bore and over a portion of the thermal actuator 50. The spring 48 is placed into the bore 56 in engagement with the spool 44 and a fitting 60 with a sealing o-ring 62 is threaded into the bore 56. The fitting 60 is provided with an opening 64 which couples the first conduit 26 to the supply line 14.

Figure 6:
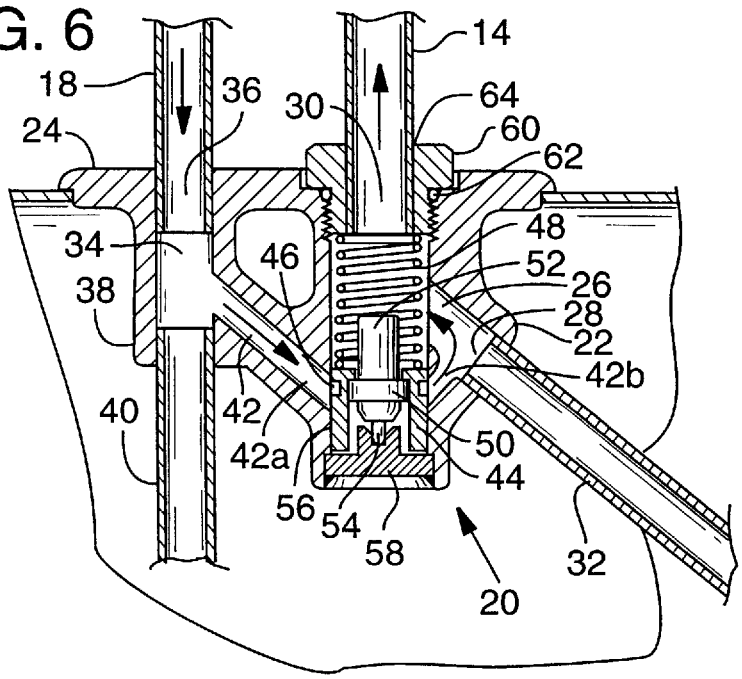
FIG. 6 is a schematic partially cut away view of the value illustrated in FIG. 5.
Figures 2, 3:
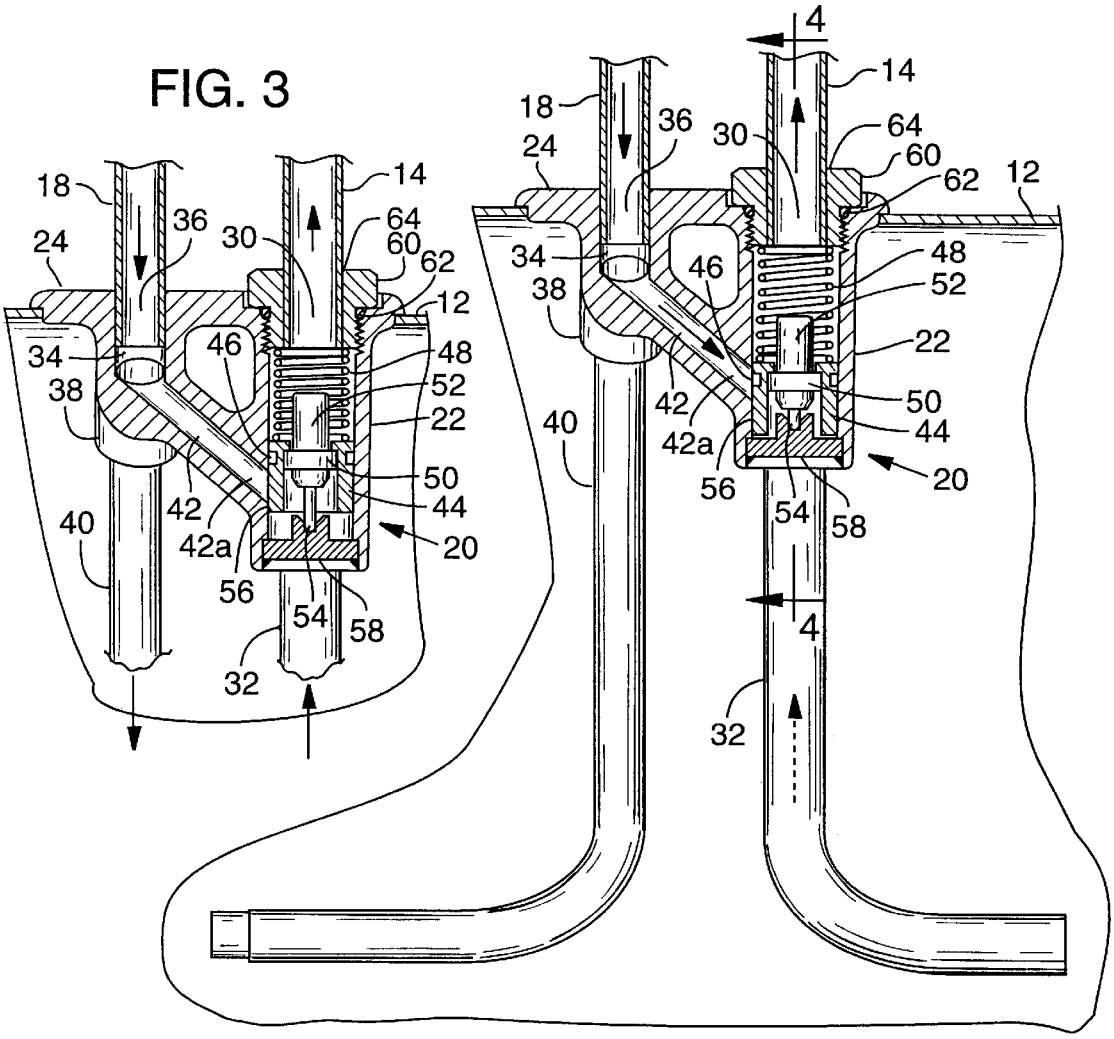
FIG. 2 is a cross sectional view of the system of FIG. 1, taken along line 2—2, showing the valve in the open position.
FIG. 3 is a cross sectional view of the system of FIG. 1, taken along line 2—2, showing the valve in the closed position.
Figure 4:
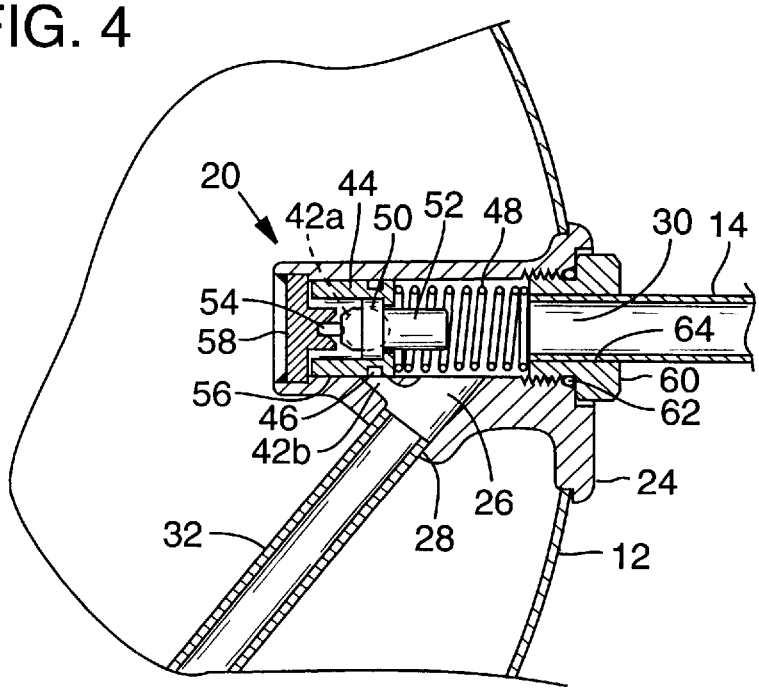
FIG. 4 is a cross sectional view taken along line 4—4 of FIG. 2.
Figure 5:
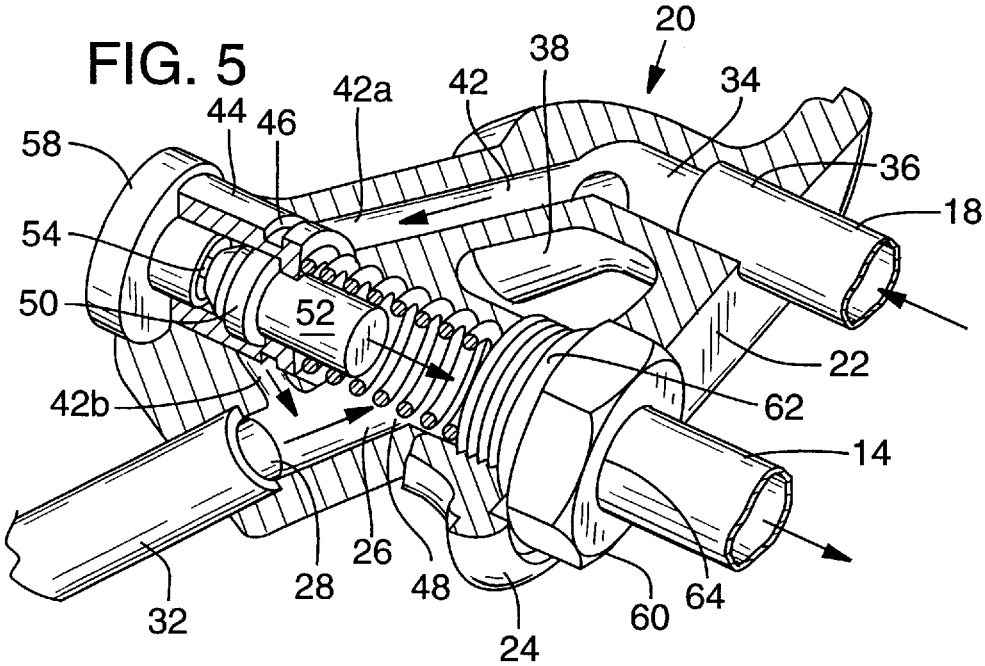
FIG. 5 is a partially cutaway perspective view of the valve illustrated in FIG. 1.

In the illustrated configuration, the spool 44 divides the third conduit 42 into two portions 42*a* and 42*b* (best seen in FIGS. 5 and 6). When the spool 44 is in the open position (FIGS. 2, 4, 5 and 6), fuel can flow from the first portion 42*a*, around the spool 44 via the annular groove 46, into the second portion 42*b*, and into the first conduit 26. When the spool 44 is in the closed position (FIG. 3), it blocks the flow of fuel from the first portion 42*a* to the second portion 42*b*. In either position, the spool 44 fits snugly enough within the bore 56 to block the flow of fuel directly from portion 42*a* into the first conduit 26. However, a minor amount of leakage around the spool is acceptable. Thus, in the illustrated embodiment, no seals or the like are used around the spool. Of course, it should be appreciated that other valve configurations might also be used to accomplish the same function as the illustrated valve.

During operation of the illustrated fuel recirculation system, fuel is drawn through the supply tube 32 into the first conduit 26. From there, the fuel passes through the supply line 14 to the engine 16. A portion of the fuel is combusted and the remainder, having been warmed by circulating through or in proximity to the running engine, is returned to the fuel tank 12 through the return line 18. Within the fuel tank 12, the fuel enters the second conduit. If the spool 44 is in the closed position, FIG. 3, all of the warmed return fuel passes through the return tube 40 where it mixes with the fuel supply in the fuel tank 12. If the spool 44 is in the open position, a portion of the warmed return fuel is diverted to flow through the third conduit 42 and into the first conduit 26 where it mixes with and warms fuel being provided to the supply line 14. The remainder of the warmed return fuel passes through the return tube 40 where it mixes with the fuel supply in the fuel tank 12.

In the illustrated embodiment, the sensor 52 is positioned within the first conduit 26 at a location downstream from the third conduit 42. As a result, the temperature sensed by the sensor 52 is that of the fuel withdrawn from the fuel tank 12 after it has been mixed with any diverted return fuel. This is preferable to sensing the temperature of either the unmixed fuel from the tank or the warmed return fuel.

The temperature at which the thermal actuator 50 is actuated may vary from one application to another. The temperature at which a fuel may begin to wax depends on the particular type and blend of fuel. In some types of diesel fuel, solids may begin to form at temperatures between about 20° F. and 25° F. However, the temperature at which waxing begins varies widely. In any case, it is preferable that the valve be in the open position at temperatures below which waxing begins. Moreover, there is typically no need to warm fuel that is above the temperatures at which waxing may occur and, in some cases, it is desirable to avoid warming the fuel. Thus, it is preferable for the valve to be closed at some point above the temperatures where waxing may occur. In the illustrated embodiment, the thermal actuator is chosen to be fully open at temperatures below about 65° F. and fully closed at temperatures above about 70° F. Of course, other operating ranges can also be used, depending on particular needs of a given system.

In the illustrated valve, the volume of diverted return fuel when the valve is fully open is about 25–50% of the volume of fuel supplied to the supply tube 14. The remainder of the returned fuel is returned to the fuel tank to to mix with and warm the fuel supply within the fuel tank. Of course, the amount of diverted fuel may vary depending on the particular needs of a given system. So long as the amount of diverted fuel is sufficient to warm and reduce unwanted waxing within the fuel components external to the fuel tank, the remainder can be returned to the fuel tank to help warm the fuel supply within the fuel tank. However, regardless of what amount is diverted, the valve of the present system diverts a predictable and controllable amount of warmed return fuel for mixing with the fuel drawn from the fuel tank.

In the illustrated embodiment, the valve 20 is located about halfway up the side of the fuel tank 12. This helps to keep the valve submerged within the fuel supply in the tank and yet locates the valve in a position where it is somewhat protected from the elements and road debris. The illustrated configuration of the valve is also easily maintained. In particular, removal of the fitting 60 provides access to replace or repair the spool 44, spring 48 and thermal actuator 50, without the need to remove the valve from the fuel tank.

The position of the valve 20 within or adjacent the fuel tank 12 helps to ensure that any diverted return fuel is mixed with and warms the fuel exiting the tank before it is exposed to the elements outside the tank. Thus, the illustrated fuel warming and recirculation system helps to protect all of the fuel system's components—not just those adjacent the engine—from waxing. As used herein, reference to the valve being positioned adjacent the fuel tank includes positions in which the valve is within the fuel tank, positions in which the valve is integral with the fuel tank and other positions in which the valve is positioned such that diverted return fuel is mixed with fuel from the fuel tank at a point which helps to protect fuel system components and fuel lines between the fuel tank and the engine from the effects of waxing.

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof.

What is claimed is:

1. In a fuel system for an internal combustion engine, the fuel system having a fuel tank for storing a quantity of fuel, a fuel recirculation system comprising:

a supply line for transporting fuel from the fuel tank to the engine;

a return line for transporting fuel from the engine to the fuel tank; and a recirculation valve positioned within the fuel tank, the recirculation valve having:

a first conduit having an inlet positioned within the fuel tank and an outlet coupled to the supply line;

a second conduit having an inlet coupled to the return line and an outlet positioned within the fuel tank;

a third conduit joining the first conduit and the second conduit;

a valve member movable between a first position in which fuel is allowed to flow from the second conduit, through the third conduit and into the first conduit and a second position in which fuel is not allowed to flow through the third conduit; and a thermal actuator for sensing a temperature of the fuel and moving the valve member between the first position and the second position based upon the sensed temperature.

2. The fuel recirculation system of claim 1 in which the temperature is sensed at a position within the first conduit downstream from the third conduit.

3. The fuel recirculation system of claim 1 in which the valve member is positioned at least partially within the third conduit.

4. The fuel recirculation system of claim 1 in which the fuel has a waxing temperature at which solids begin to form within the fuel and in which the thermal actuator positions the valve member in the first position when the sensed temperature is below the waxing temperature.

5. The fuel recirculation system of claim 4 in which the thermal actuator positions the valve member in the second position when the sensed temperature is some temperature above the waxing temperature.

6. The fuel recirculation system of claim 2 in which the thermal actuator positions the valve member in the first position when the sensed temperature is less than about 65° F. and positions the valve member in the second position when the sensed temperature is greater than about 70° F.

7. The fuel recirculation system of claim 1 in which the volume of fuel flow through the third conduit when the valve member is in the first position is 25–50% of the volume of the fuel flow out of the first conduit.

8. A valve for a fuel recirculation system of an internal combustion engine, the fuel recirculation system having a fuel tank for storing a quantity of fuel having a waxing temperature at which solids begin to form within the fuel, a supply line to supply fuel from the fuel tank to the engine and a return line to return fuel from the engine to the fuel tank, the valve comprising:

a valve body positioned within the fuel tank, the valve body defining:

a first conduit having an inlet for receiving fuel from the fuel tank and an outlet coupled to the supply line;

a second conduit having an inlet coupled to the return line and an outlet; and a third conduit joining the first conduit and the second conduit;

a valve member positioned at least partially within the third conduit, the valve member movable between a first position in which the third conduit is not obstructed and a second position in which the third conduit is obstructed; and a thermal actuator for sensing a temperature of the fuel and moving the valve member between the first position and the second position based upon the sensed temperature, whereby the valve allows the flow of fuel from the second conduit, through the third conduit and into the first conduit when the sensed temperature is below a predetermined temperature to allow fluid from the second conduit to mix with fuel in the first conduit.

9. The valve of claim 8 in which the thermal actuator senses the temperature of the fuel within the first conduit at a location downstream from the third conduit such that the thermal actuator senses the temperature of the mixed fuel.

10. The valve of claim 9 in which the thermal actuator positions the valve member in the first position when the sensed temperature is below the waxing temperature.

11. The valve of claim 10 in which the thermal actuator positions the valve member in the second position when the sensed temperature is some temperature greater than the waxing temperature.

12. The valve of claim 9 in which the predetermined temperature is greater than the waxing temperature.

13. The valve of claim 9 in which the volume of fuel flow allowed through the third conduit when the valve member is in the first position is 25–50% of the volume of the fuel flow out of the first conduit.

14. A method of recirculating fuel in a fuel supply system for an internal combustion engine having a fuel tank for storing a supply of fuel having a waxing temperature at which solids begin to form in the fuel, a supply line for transporting fuel from the fuel tank to the engine, and a return line for transporting fuel from the engine to the fuel tank, the method comprising the steps of:

providing a first quantity of fuel to the supply line to be transported to the engine;

returning a second quantity of fuel from the engine through the return line to the fuel tank;

determining whether the temperature of the first quantity of fuel is below a predetermined temperature;

in response to a positive determination, diverting part of the second quantity of fuel after it is returned to the fuel tank but before it mixes with the supply of fuel; and adding the diverted part to the first quantity of fuel at a location within the fuel tank.

15. The method of claim 14 in which the diverted part is equal to 25–50% of the first quantity.

16. The method of claim 14 in which the predetermined temperature is above the waxing temperature.

* * * * *